US007617967B2

(12) United States Patent
Koessendrup

(10) Patent No.: US 7,617,967 B2
(45) Date of Patent: Nov. 17, 2009

(54) RINGS AND CONTAINERS FOR PACKAGING

(75) Inventor: Klaus Michael Koessendrup, Schifferstadt (DE)

(73) Assignee: ABRO Weidenhammer GmbH, Hockenheim (DE)

( * ) Notice: Subject to any disclaimer, the term of this patent is extended or adjusted under 35 U.S.C. 154(b) by 770 days.

(21) Appl. No.: 11/185,117

(22) Filed: Jul. 20, 2005

(65) Prior Publication Data

US 2006/0021988 A1 Feb. 2, 2006

Related U.S. Application Data

(63) Continuation-in-part of application No. 10/899,877, filed on Jul. 27, 2004, now Pat. No. 7,458,500.

(51) Int. Cl.
*B65D 3/28* (2006.01)
*B65D 3/10* (2006.01)

(52) U.S. Cl. ..... 229/5.5; 229/4.5; 229/125.13

(58) Field of Classification Search ..... 229/4.5, 229/5.5, 5.6, 5.7, 5.8, 125.13; 220/642, 643, 220/644

See application file for complete search history.

(56) References Cited

U.S. PATENT DOCUMENTS

| | | | | |
|---|---|---|---|---|
| 2,335,202 | A | 11/1943 | Wilcox | |
| 3,186,620 | A | 6/1965 | Meijers | |
| 3,297,193 | A * | 1/1967 | Stevens, Jr. | 220/782 |
| 3,315,865 | A | 4/1967 | Bracht | |
| 3,377,014 | A | 4/1968 | Heinz | |
| 3,408,902 | A | 11/1968 | De Voe | |
| 3,434,651 | A | 3/1969 | Frederick | |
| 3,561,637 | A | 2/1971 | McConnell | |
| 4,042,169 | A * | 8/1977 | Burgdorf | 229/125.26 |
| 4,091,929 | A | 5/1978 | Krane | |
| 4,094,460 | A | 6/1978 | Scanga et al. | |
| 4,182,475 | A * | 1/1980 | Freund | 229/5.7 |
| 4,252,265 | A * | 2/1981 | Brundige et al. | 229/5.7 |
| 4,289,265 | A | 9/1981 | Ellerbrock | |
| 4,346,815 | A | 8/1982 | Raymor et al. | |
| 4,346,832 | A | 8/1982 | Werner | |
| 4,369,892 | A | 1/1983 | Uhlig | |
| 4,531,930 | A | 7/1985 | Clauss | |
| 4,546,911 | A | 10/1985 | Clauss | |
| 4,738,365 | A | 4/1988 | Prater | |
| 4,785,992 | A | 11/1988 | Goeppner | |
| 4,826,008 | A * | 5/1989 | Cloosterman | 229/5.7 |

(Continued)

OTHER PUBLICATIONS

"U.S. Appl. No. 11/287,416 Non-Final Office Action mailed Jun. 15, 2007", 6 pgs.

(Continued)

*Primary Examiner*—Gary E Elkins
(74) *Attorney, Agent, or Firm*—Schwegman, Lundberg & Woessner, P.A.

(57) ABSTRACT

Rings and containers for packaging of goods are provided. The containers include the rings. Each ring covers a top sidewall of a container. Moreover, each ring includes a first side and a second side. The first side extends along an outer portion of the top sidewall and the second side extends along an inner portion of the top sidewall. The first side extends farther down the top sidewall than the second side. The second side also includes an inside, which has ribs that adhere to the inner portion of the top sidewall. Furthermore, each rib has a hook or ridge.

10 Claims, 5 Drawing Sheets

U.S. PATENT DOCUMENTS

| | | | | | |
|---|---|---|---|---|---|
| 4,852,793 | A | | 8/1989 | Homma et al. | |
| 4,971,201 | A | * | 11/1990 | Sathre | 220/642 |
| 5,025,982 | A | * | 6/1991 | Lisiecki | 229/125.13 |
| 5,123,573 | A | * | 6/1992 | Kucherer | 229/125.05 |
| 5,258,086 | A | | 11/1993 | Hale | |
| 5,638,983 | A | * | 6/1997 | Bazany | 220/642 |
| 6,116,422 | A | | 9/2000 | Rabe et al. | |
| 6,138,899 | A | | 10/2000 | Grabher | |
| 6,165,115 | A | | 12/2000 | Rea | |
| 6,401,967 | B1 | | 6/2002 | Rabe et al. | |
| 6,592,025 | B2 | * | 7/2003 | Bazany et al. | 220/642 |
| 7,458,500 | B2 | * | 12/2008 | Whitaker et al. | 229/5.5 |
| 2003/0116579 | A1 | | 6/2003 | Chambers | |
| 2006/0022021 | A1 | | 2/2006 | Whitaker et al. | |
| 2006/0073959 | A1 | | 4/2006 | Koessendrup | |
| 2008/0149693 | A1 | | 6/2008 | Whitaker et al. | |

OTHER PUBLICATIONS

"U.S. Appl. No. 12/043,316, Response Filed Dec. 23, 2008 to Restriction Requirement mailed Nov. 26, 2008.", 6 pgs.

"U.S. Appl. No. 12/043,316 ,Non-Final Office Action maild Apr. 1, 2009", 6 pgs.

* cited by examiner

RINGS AND CONTAINERS FOR PACKAGING

RELATED APPLICATIONS

The present invention is a Continuation-In Part of U.S. application Ser. No.: 10/899,877; filed on Jul. 27, 2004 now U.S. Pat. No. 7,458,500; entitled "Commercial Bulk Ice Cream or Frozen Novelty Container and Method of Manufacture." The disclosure of which is incorporated by reference herein.

FIELD

The invention relates generally to packaging materials and more particularly to rings and containers used in packaging of goods.

BACKGROUND

Containers generally include a variety of components such as sidewalls, bottoms, and/or lids or coverings. Commercial containers are designated as such because these types of containers often have a larger volume capacity for housing goods than what is typically available in consumer-based packaging products. The strength required by commercial packaging to support a larger volume of goods often dictates that more expensive materials and/or manufacturing processes be used to produce the commercial containers.

Thus, if less expensive materials are used, such as paper-based materials, then different manufacturing techniques and arrangements are needed to provide proper support to the containers. Less expensive materials often require more expensive manufacturing techniques. Conversely, less expensive manufacturing techniques often require more expensive raw materials.

As an example, consider a bulk frozen novelty container having a paper-based sidewall with a bottom and a top. In many cases the bottom and top may require a heat seal manufacturing technique to support the volume of frozen novelty. Such a technique requires precision and can be tricky and expensive to manufacture. As a result, some bulk frozen novelty manufacturers may elect to use metal top rings, which do not require a heat seal. However, the metal top ring introduces other problems related to safety because when the product is dispensed from such a container having a metal top ring, a hand can knick the ring and cause blood to spill into the product.

Moreover, by introducing disparate materials into a container's construction manufacturing becomes more error prone and more expensive. It is also note worthy that metal-based materials, which may be used in a container's construction, cannot be scanned for purposes of detecting foreign metallic materials, which may have been inadvertently introduced into the product during its manufacture.

SUMMARY

In various embodiments, rings and containers are provided for packaging products. More particularly and in an embodiment, a container ring is provided. The ring includes an injection molded plastic part to cover a top sidewall of a container. The injection molded plastic part also includes a first side and a second side. The first side has a first length to fit over an outside portion of the top sidewall. The second side has a second length to fit over an inside portion of the top sidewall. The first length is greater than the second length. Moreover, the second side of the injection molded plastic part includes a plurality of plastic ribs to adhere to the inside portion of the top sidewall. Each plastic rib has a hook shape.

DETAILED DESCRIPTION

Figure 1A:
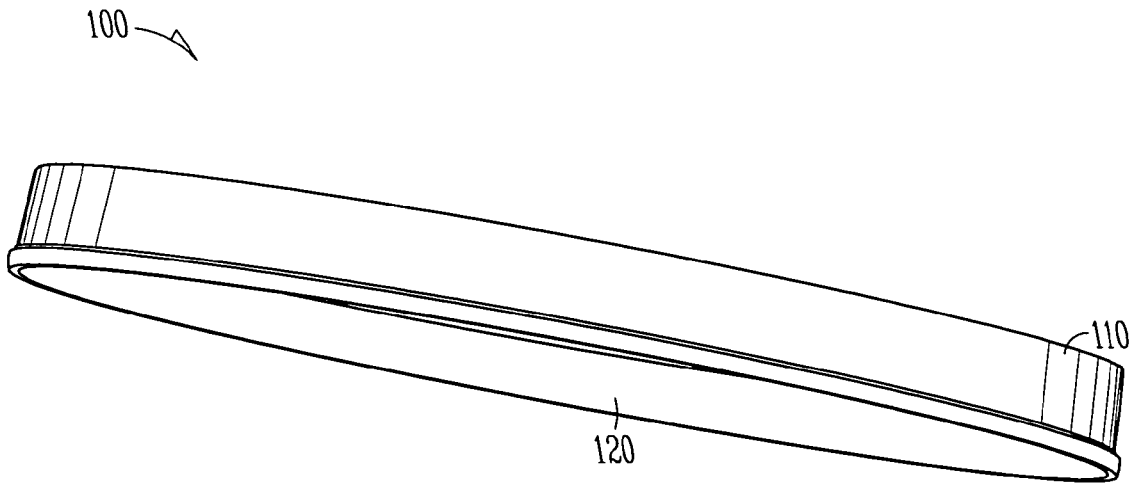
FIG. 1A is a diagram of a ring used with containers in packaging, according to an example embodiment.

FIG. 1A is a diagram of a ring 100 used with containers in packaging, according to an example embodiment. The diagram is presented for purposes of illustration and is not intended to be drawn to scale. Moreover, the shape of the ring 100 is circular in FIG. 1A. It is however to be understood that the ring's shape may be manufactured according to the shape and circumference of the container on which it is affixed. Accordingly, the ring 100 may take on shapes such as, but not limited to, circles, rectangles, squares, ovals, etc.

The ring 100 includes a first side 110 and a second side 120. It may be formed as a continuous injection molded plastic part or derivatives thereof. The first side 110 and the second side 120 are joined by a top ledge. The ring 100 is manufactured to achieve a snug fit over the top sidewall of a container. The ring 100 does not require any kind of heat sealing to be affixed to the sidewall. It may be affixed by hand or by a mechanical device. The first side 110, when the ring 100 is affixed to a sidewall of a container, is oriented to the outside of the container. Conversely, the second side 120 is oriented to the inside of the container that may house product.

Moreover, the ring 100 is designed to provide structural support to the container to which it is affixed. In this manner, large commercial containers can benefit from using the ring 100 with containers that need top-end structural support to support the products that are housed in the containers.

For example, a commercial frozen-novelty container made of a paper-based material may use the ring 100 to achieve structural support to house the frozen novelty product. However, it is to be understood that the ring 100 and its novel construction and use described herein and below may be used with a wide variety of packaging containers including consumer-based packaging containers. In this sense, the ring 100 is not intended to be limited to any particular type of container or any particular type of product that is housed by a container.

Figure 1B:
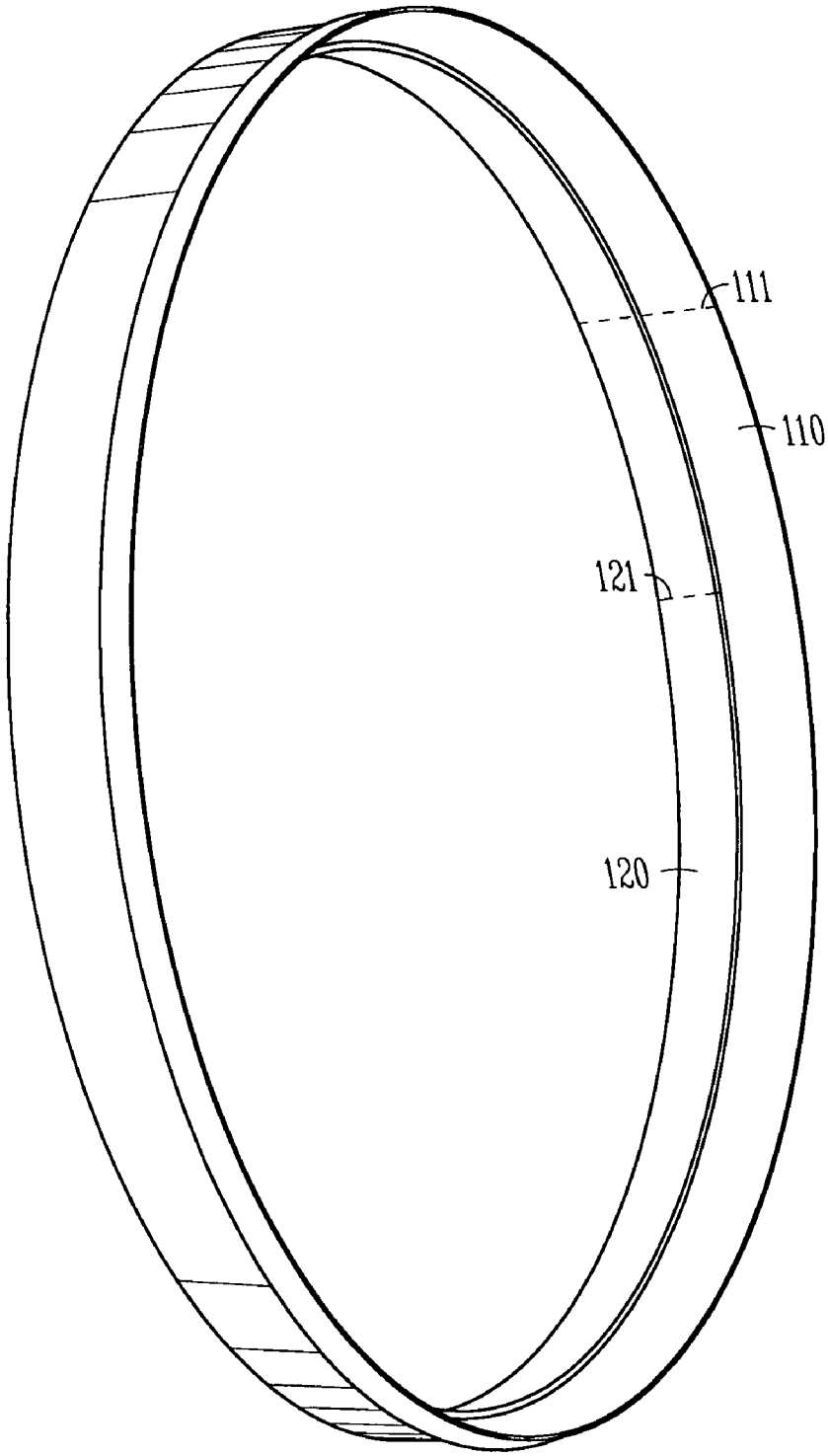
FIG. 1B is a diagram of an upside down and inside view of the ring presented in FIG. 1, according to an example embodiment.

FIG. 1B is a diagram of an upside down and inside view of the ring 100 presented in FIG. 1, according to an example embodiment. The diagram of FIG. 1B is oriented such that the inside of the ring 100 is visible and such that the ring 100 is partially upside down. It is upside down in the sense that it needs flipped 90 degrees to the right to be affixed to a top sidewall of a packaging container. Moreover, only a portion of the upside down inside view of the ring 100 is presented in FIG. 1B. This orientation is presented to illustrate useful and novel features of the ring 100.

In FIG. 1B, the ring 100 includes a first sidewall 110 and a second sidewall 120. The second sidewall 120 is illustrated with dashed lines. The first side 110 of the ring 100 includes an inner portion that interfaces to a container to which it is affixed. Likewise, the second side 120 of the ring 100 includes an inside or inner portion that interfaces to a container to which it is affixed.

The first side 110 is manufactured to a configurable first length 111, which is also illustrated by the dashed lines in the FIG. 1B. Similarly, the second side 120 is manufactured to a configurable second length 121 and is likewise illustrated by dashed lines in the FIG. 1B.

The first length 111 is greater than the second length 121. In an embodiment, the first length 111 is approximately two and half times the size as the second length 121. This arrangement provides novel structural support to a container to which it is affixed and simultaneously provides for a portion of a novel mechanism that allows the ring to be mechanically or hand fit onto the sidewall of a container for a stable and snug fit. Other features of the inner portion of the second side 120 will now be discussed in greater detail.

Figure 1C:
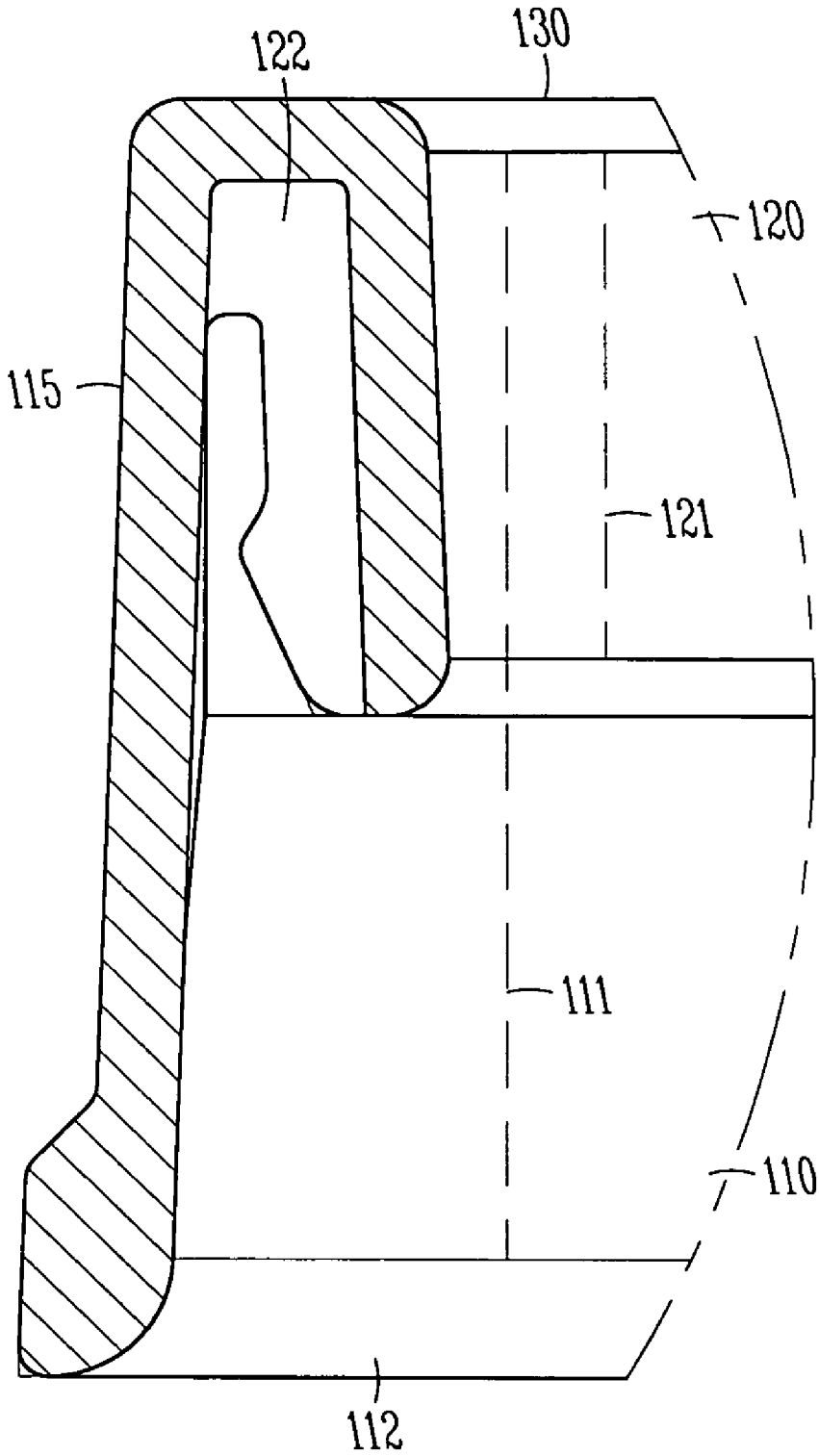
FIG. 1C is a cross sectional diagram of an inside portion of the ring presented in FIG. 1, according to an example embodiment.

FIG. 1C is a cross sectional diagram of an inside portion of the ring 100 presented in FIG. 1, according to an example embodiment. This view of the ring 100 provides detail of the inside portion of the second side 120 of the ring 100 that interfaces to a container to which it is affixed. It also provides detail for the inside portion of the first side 110 of the ring 100. The FIG. 1C also illustrates other features of the ring 100, which will now be discussed in greater detail.

The first side 110 of the ring 100 includes a lip or protruding ridge 112. The lip 112 allows the ring 100 to be gripped and removed from a container on which it is affixed and may also provide additional structural support to the container and the ring 100. The top of the ring 100 includes a ledge 130 that joins the first side 110 and the second side 120 of the ring together. The ledge 130, when affixed to a container, is perpendicular to the sidewall and runs along the circumference of the sidewall.

Again, in the FIG. 1C the first side 110 includes a first length 111 that is larger than the second length 121 of the second side 120. Inside of both the first side 110 and the second side 120 a rib 115 is manufactured or formed in the ring 100. The rib runs the length of the first side 110 and then extends onto the top ledge 130 and continues for the second length 121 on the inside of the second side 120. In addition, the rib 115 is interfaced to or continues back down the second side 120 to form another rib or hook shape 122.

When the ring 100 is pressed or affixed to the top of a sidewall for a container, the hook or rib 122 is forced away from rib 115 that runs along the inside portion of the first side 110 and toward the rib 115 that continues to run along the inside portion of the second side 120. The top of the sidewall fits in between rib 115 and rib or hook 122. This creates force and friction that adheres the ring 100 to the top sidewall of the container to which the ring 100 is being affixed. This also permits the ring 100 to be applied by hand or by mechanical device; rather, than by a heat seal or other more expensive and/or cumbersome manufacturing technique.

Once the ring 100 is affixed to a container, the lip 112 can be grabbed to detach the ring 100. The ring 100 may be easily reattached or removed in the manners discussed above. Thus, the ring 100 is reusable unlike conventional approaches where the ring 100 may become one with the container and integrated with its container.

The ring 100 is manufactured or molded as an injection molded plastic part or derivative thereof. The size and shape of the injection molded part is designed to the shape and circumference of a top sidewall for a particular desired container. The first side 110 of the injection molded part has an inside and outside portion and a first length 111. The second side 120 of the injection molded part also has an inside and an outside portion and a second length 121. The first length 111 is greater than the second length 121, and the inside portions interface with the sidewall of a container to which the ring 100 is affixed on opposing sides of the sidewall.

The second side 120 includes a plurality of ribs 122 on the inside portion of the second side 120. The ribs 122 interface to an inside portion of the sidewall for a container when the ring 100 is affixed thereto. The second side 120 resides on the inside of the sidewall, while an inner portion of the first side 110 resides on an outer portion of the sidewall when the ring 100 is affixed to a container.

In an embodiment, the ribs 122 are evenly distributed on the inner portion of the second side 120 for the entire circumference or perimeter of the ring 100. In a like manner the ribs 115 may be evenly distributed on the inner portion of the first side 110. In some cases, the distribution of the ribs 122 within the inner portion of the second side 120 is approximately 1 centimeter, such that each rib 122 is about 1 centimeter from neighboring ribs 122.

Figure 2:
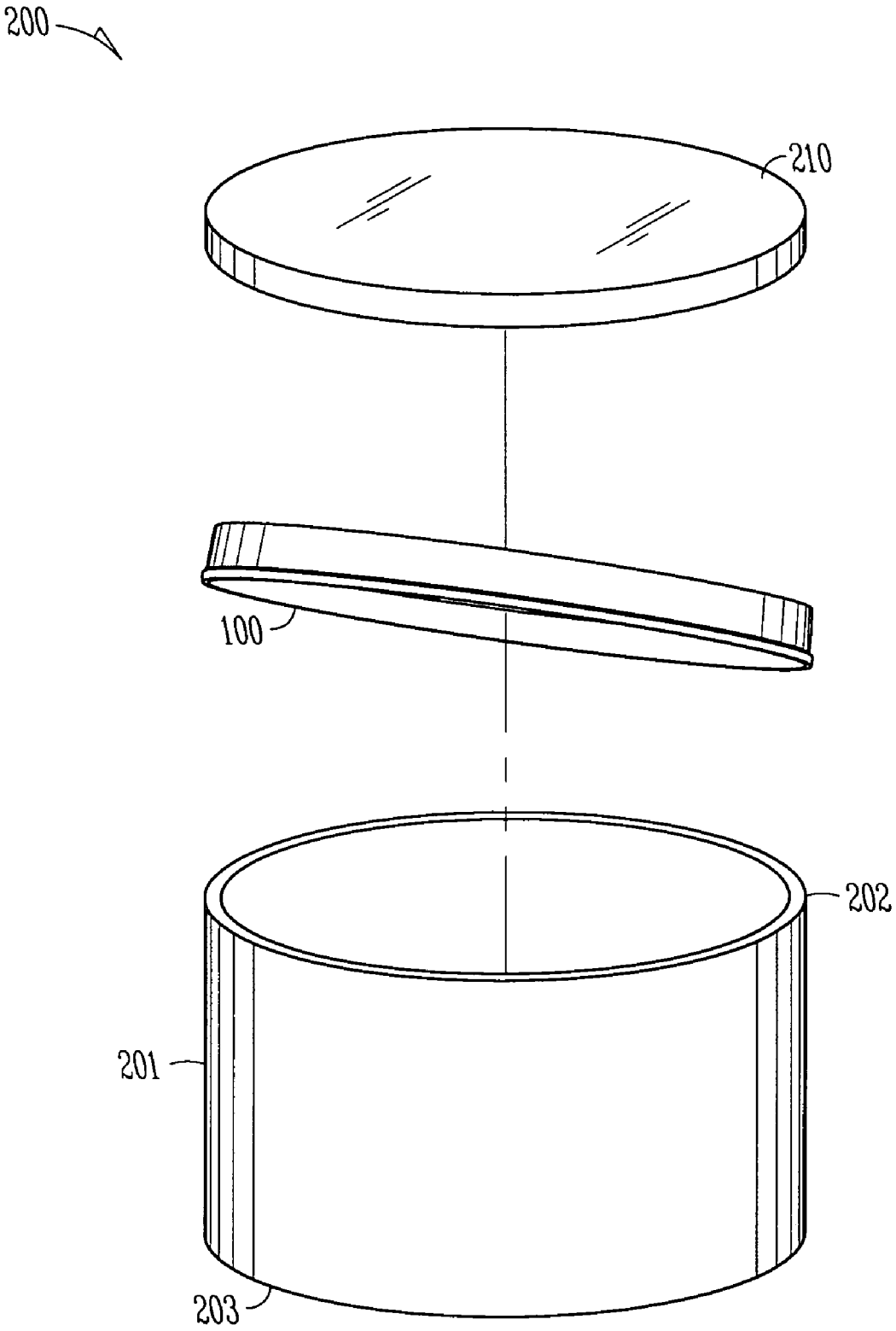
FIG. 2 is a diagram of a container used in packaging that includes the ring presented in FIG. 1, according to an example embodiment.

FIG. 2 is a diagram of a container 200 used in packaging that includes the ring 100 presented in FIG. 1, according to an example embodiment. The container 200 diagram is not intended to be drawn to scale and is presented for purposes of illustration.

The container 200 includes a sidewall 201, a top portion of the sidewall 202, a bottom 203, and the ring 100, which has been described above with respect to FIGS. 1A-1C. In an embodiment, the container 200 also includes a lid 210. Each of these will now be discussed in turn.

The sidewall 201 may be constructed of any material and may be of any desired manufactured size or shape. Thus, the sidewall 201 may be a commercial size or a size associated with consumers. In an embodiment, the sidewall 201 is made of a paper-based material including a paper-based bottom 203 and lacks any metal-based material.

The top portion 202 of the sidewall 201 has approximately the same circumference as the ring 100, or in some cases the circumference of the top portion 202 is slightly smaller than a circumference of the ring 100. The top portion 202 is designed to receive the bottom of the ring 100

The bottom 203 may be manufactured as a separate component of the container 200 and made of the same material of the sidewall 201. Alternatively, the bottom 203 may be manufactured as a continuous part of the sidewall 201. In an embodiment, the sidewall 201 and the bottom 203 are two separate paper-based manufactured components, and the bottom is heat sealed to the bottom of the sidewall 201. It is understood, that any technique recognized by one of ordinary skill in the packaging arts may be used to manufacture and affix or seal the bottom 203 to the sidewall 201.

The ring 100 includes a first side 110 having an inner and outer portion. The ring 100 also includes a second side 120 having an inner and outer portion. The first side 110 is larger than the second side 120. Moreover, the inner portion of the second side 120 includes a plurality of ribs 122 that force over and apply friction against an inner portion of the top portion 202 of the sidewall 201 when the ring 100 is affixed to the sidewall 201.

In an embodiment, each rib 122 of the ring 100 forms a hook shape along a bottom portion of the second side 120 of the ring 100. Moreover, the first side may also include a plurality of ribs 115, such that each rib 122 extends outward from the ring 100 at a greater distance than each rib 115. In other words, the ribs 122 protrude or are of a thicker in size than ribs the 115. This facilitates a greater friction against the top portion 202 when the ring 100 is pressed onto the sidewall 201.

According to an embodiment, the container 200 also includes a lid 210. The lid 210 is designed or manufactured to be placed over the ring 100 and the top portion 202 of the sidewall 201 for purposes of closing the container 200. The lid 210 may be made of the same or different material as the sidewall 201 and/or the ring 100. In an embodiment, the ring 100 is manufactured as an injection molded plastic part or a plastic derivative.

Figure 3:
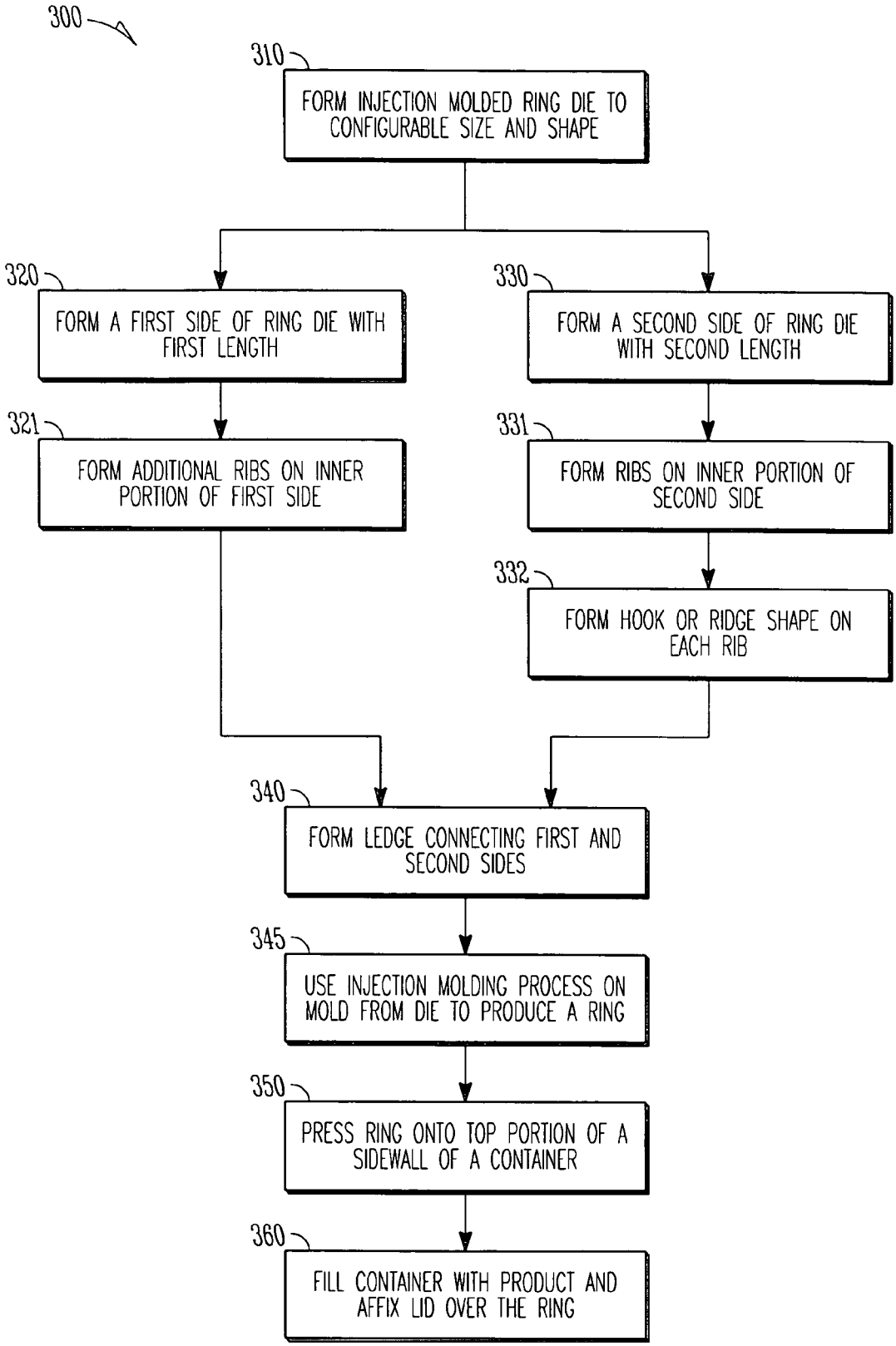
FIG. 3 is a diagram of a method for manufacturing and using the ring presented in FIG. 1, according to an example embodiment.

FIG. 3 is a diagram of a method 300 for manufacturing and using the ring 100 presented in FIG. 1, according to an example embodiment. The method 300 may be practiced in an injection molding environment and/or a packaging manufacturing environment using the equipment and techniques known and used by one of ordinary skill in the injection molding and packaging arts.

The method 300 when practiced produces an injection molded ring die from which the ring 100 presented above with respect to the FIGS. 1A-1C may be produced from molds produced from the dies. Moreover, the method 300 may be practiced in connection with the fabrication process associated with making containers, such as the container 200 of FIG. 2. Finally, portions of the method 300 may be practiced at facilities that fill containers with product.

It is to be understood that the blocks shown in FIG. 3 are not intended to impart any particular sequence. That is, one of ordinary skill in the injection molding arts may practice the method 100 in any desired order, without departing from the teachings presented herein.

At 310, an injection molded ring die is formed to a configurable size and shape from a desired material used in injection molding processes. In an embodiment, ring die is a circular shape and having a circumference size of approximately the same size as that of a container's circumference to which a produced ring 100 is to be affixed.

During 310, the ring die is formed, at 320, such that a first side 110 of the ring die is made having a first length 111. Likewise, at 330, a second side 120 is formed having a second length 121. The first length 111 is greater than the second length 121. At 331, a plurality of ribs 122 is formed on the inner portion of the second side 120. Furthermore, at 332, each rib 122 forms a hook or ridge along a portion of each rib 122.

In some embodiments, at 321, the inner portion of the first side 110 may also include a plurality of additional ribs 115. In some cases, the additional ribs 115 are continuously connected and joined with the ribs 122 of the second side 120.

At 340, a ledge 130 is formed along the top of the ring die that joins and connects the first side 110 with the second side 120. The ledge is oriented to the top of the ring die, such that any produced ring 100 from a mold of the ring die when affixed to a container is perpendicular to the sidewall of that container.

After 340, the ring die is manufactured for a desired container. At 345, injection molding may be used with a mold produced from the ring die to generate a ring 100. Accordingly, the method may be further practiced, at 350, by pressing via hand or mechanical device the produced ring 100 onto a top portion of a sidewall of the desired container.

In some cases, at 360, the method 100 may be practiced further at a distribution or manufacturing plant of a product vendor for purposes of filling the container with a desired product and affixing a lid over the container. The container with the product may then be shipped or sold.

The ring 100 provides novel features to containers 200 used with packaging products, such that the containers 200 may be more easily assembled and achieve greater structural support from the ring 100. This can reduce manufacturing complexity, expense, and time to market. Additionally, because the rings 100 of the present invention are portable, they maybe detached from one container 200 as desired and reapplied to the same container 200 or a different container 200.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A container ring, comprising:

an injection molded plastic part to cover a circumference of a top sidewall of a container;

a first side of the injection molded plastic part having a first length to fit over an outside portion of the top sidewall;

a second side of the injection molded plastic part having a second length to fit over an inside portion of the top sidewall, wherein the first length is greater than the second length;

a plurality of plastic ribs located on an inside of the second side of the injection molded plastic part to adhere to the inside portion of the top sidewall, wherein each of the plastic rib has a hook shape; and a plurality of additional plastic ribs situated on an inside of the first side of the injection molded plastic part, wherein each additional plastic rib is opposite one of the plastic ribs associated with the inside of the second side of the injection molded plastic part; wherein each of the additional plastic ribs extend beyond the second length along the inside of the first side of the injection molded plastic part.

2. The container ring of claim 1, wherein the first length is two and half times as large as the second length.

3. The container ring of claim 1, wherein the plurality of plastic ribs are evenly distributed on the inside of the second side of the injection molded plastic part.

4. The container ring of claim 1, wherein each hook shape of each of the plastic ribs forms a ridge proximate to a bottom side of the second side of the injection molded plastic part.

5. A container, comprising:

a sidewall;

a bottom affixed to a bottom portion of the sidewall; and a ring affixed to a top portion of the sidewall, wherein the ring includes a first side having an outer portion and an inner portion, the ring also includes a second side having an outer portion and an inner portion, and wherein the first side is larger than the second side, and the inner portions of the first side and the second side fit over the top portion of the sidewall, and wherein the inner portion of the second side includes ribs that force into the top portion of the sidewall to adhere the ring to the sidewall, wherein the inner portion of the first side of the ring includes a plurality of additional ribs, and wherein each rib of the second side extends outward from the second side at a greater distance than each additional rib of the first side extends outward from the first side.

6. The container of claim 5, wherein the ring and the top portion of the sidewall have a shape that is at least one of square, circular, rectangular, and oval.

7. The container of claim 5, wherein each of the ribs includes a hook or a rib shape along a bottom portion of the second side.

8. The container of claim 5, wherein the ring is an injection molded plastic part.

9. The container of claim 8, wherein the sidewall is made of a paper-based material.

10. The container of claim 5 further comprising, a lid to fit over the ring.

* * * * *

UNITED STATES PATENT AND TRADEMARK OFFICE

CERTIFICATE OF CORRECTION

PATENT NO. : 7,617,967 B2
APPLICATION NO. : 11/185117
DATED : November 17, 2009
INVENTOR(S) : Klaus Michael Koessendrup It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1152 days.

Signed and Sealed this

Nineteenth Day of October, 2010

David J. Kappos

David J. Kappos
*Director of the United States Patent and Trademark Office*